US005182854A

United States Patent [19]

Voss

[11] Patent Number: 5,182,854

[45] Date of Patent: Feb. 2, 1993

[54] METHOD FOR METALLURGICALLY BONDING PRESSED-IN CYLINDER LINERS TO A CYLINDER BLOCK

[75] Inventor: Karl D. Voss, Farmington Hills, Mich.

[73] Assignee: CMI International, Inc., Southfield, Mich.

[21] Appl. No.: 822,537

[22] Filed: Jan. 15, 1992

[51] Int. Cl.[5] ..... F02F 1/00

[52] U.S. Cl. ..... 29/888.061; 29/888.06; 29/525

[58] Field of Search ..... 29/888.061, 888.06, 29/888.044, 888.048, 458, 525; 123/193 C

[56] References Cited

U.S. PATENT DOCUMENTS

| | | | |
|---|---|---|---|
| 1,710,136 | 4/1929 | Angle et al. | 123/193 |
| 2,085,529 | 6/1937 | Heinbach et al. | 29/888.061 |
| 2,455,457 | 12/1948 | Whitfield et al. | 309/2 |
| 3,069,209 | 12/1962 | Bauer | 309/3 |
| 3,073,290 | 1/1963 | Stump | 29/888.061 |
| 3,165,983 | 1/1965 | Thomas | 92/169 |
| 3,276,082 | 10/1966 | Thomas | 22/204 |
| 4,936,270 | 6/1990 | Ushio et al. | 123/193 C |
| 4,986,230 | 1/1991 | Panyard et al. | 123/193 C |
| 4,999,912 | 3/1991 | Cuccato et al. | 29/888.061 |
| 5,005,469 | 4/1991 | Ohta | 92/169.4 |
| 5,012,776 | 5/1991 | Yamagata | 29/888.061 |

FOREIGN PATENT DOCUMENTS

| | | | |
|---|---|---|---|
| 0166429 | 9/1984 | Japan | 29/888.061 |
| 0196131 | 11/1984 | Japan | 29/888.061 |
| 0043233 | 3/1990 | Japan | 29/888.061 |

*Primary Examiner*—Irene Cuda

*Attorney, Agent, or Firm*—Reising, Ethington, Barnard, Perry & Milton

[57] ABSTRACT

A method for metallurgically bonding a cylinder liner 22 within a clinder block 14 of an automotive engine includes coating the outer surface of the liner 22 with a low melting point molten metal coating material 24, such as a zinc, as well as cylinder walls of the block 14 and then allowing the coatings to solidify. The block 14 and liner 22 are then heated to an elevated temperature and the liner 22 press-fit into the block 14. This causes the coating materials to alloy with the liner and block metal as well as one another, forming a metallurgical bond between the block 14 and liner 22 when cooled.

13 Claims, 1 Drawing Sheet 12
14
16
20
22
24
26
28
30
32
34
36
38
40
42
44
46

METHOD FOR METALLURGICALLY BONDING PRESSED-IN CYLINDER LINERS TO A CYLINDER BLOCK

BACKGROUND OF THE INVENTION

1. Technical Field

The subject invention relates generally to cylinder blocks for internal combustion engines, and more particularly to such cylinder blocks having cylinder liners which are metallurgically bonded to the block.

2. Description of the Prior Art

Aluminum cylinder blocks for internal combustion engines are typically provided with cylinder liners made of cast iron or other suitable material for providing a high wear-resistant surface to the cylinder walls of the cylinder block. In order to prevent the liners from moving and rendering the engine inoperable, it is important that the cylinder liners be securely joined to the cylinder block.

One common method for joining the liners to the block is to form a mechanical interference or interlock between the liner and the block. One method involves pressing the liners into the engine block with an interference fit, relying on the friction between the liner and the block to hold the liner in place. Another method is to cast the cylinder block around the cylinder liners to form such a mechanical interlock or interference. Although these types of liners have enjoyed some commercial success, they are deficient in that mechanically joined liners tend to loosen over time due to the continuous thermal cycling of the engine and the different co-efficiency of expansion of the liner and cylinder block materials. An example of such a liner is disclosed in the U.S. Pat. No. 3,069,209 to Bauer, granted Dec. 18, 1962.

Another method for joining the liner to the cylinder block is to metallurgically bond the liner to the block. The methods known thus far involve coating the outer surfaces of preformed liners with a low melting point metal material and then positioning these coated liners in a mold and casting the cylinder block around the coated liners, which causes the coating to melt an alloy with the block and liner material to form a metallurgical bond between the liners and the block. Examples of such cast-in-place methods are disclosed in the U.S. Pat. Nos. 1,710,136 to Angle et al, granted Apr. 23, 1929; 3,165,983, granted Jan. 19, 1965 and 3,276,082 granted Oct. 4, 1966, both to Thomas, and 5,005,469, granted Apr. 9, 1991 to Ohta. With all of these cast-in-place lining methods, special care must be taken to properly position the liners within the casting mold prior to casting.

Thus, the methods available in today's technology are either inadequate, in the case of mechanical bonded liners, or require special fixturing, in the case of cast-in place metallurgically bonded liners, in order to properly locate these liners within the resultant cast cylinder block.

SUMMARY OF THE INVENTION AND ADVANTAGES

The subject invention provides a method for metallurgically bonding a cylinder liner to a cylinder block of an internal combustion engine. The method includes the steps of casting a metal cylinder block having at least one piston cylinder of fixed diameter, forming a cylindrical-shaped tubular liner from high wear-resistant metal material having an outer surface diameter slightly larger than the diameter of the piston cylinder, applying low melting point molten metal coating material to at least one of the liner and cylinder wall surfaces, heating the cylinder block and liner to an elevated temperature, and then forcing the liner into the piston cylinder with an interference fit causing the coating material to alloy with the liner and cylinder block metals whereupon cooling the alloyed coating material metallurgically bonds the liner to the block.

One advantage of the subject invention is that the liners and cylinder block can be prefabricated before metallurgically bonding them together. Thus, this process could be used by companies who might not have expensive casting facilities which are required for cast-in-place metallurgical bonding.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figures 1, 2, 3, 4:
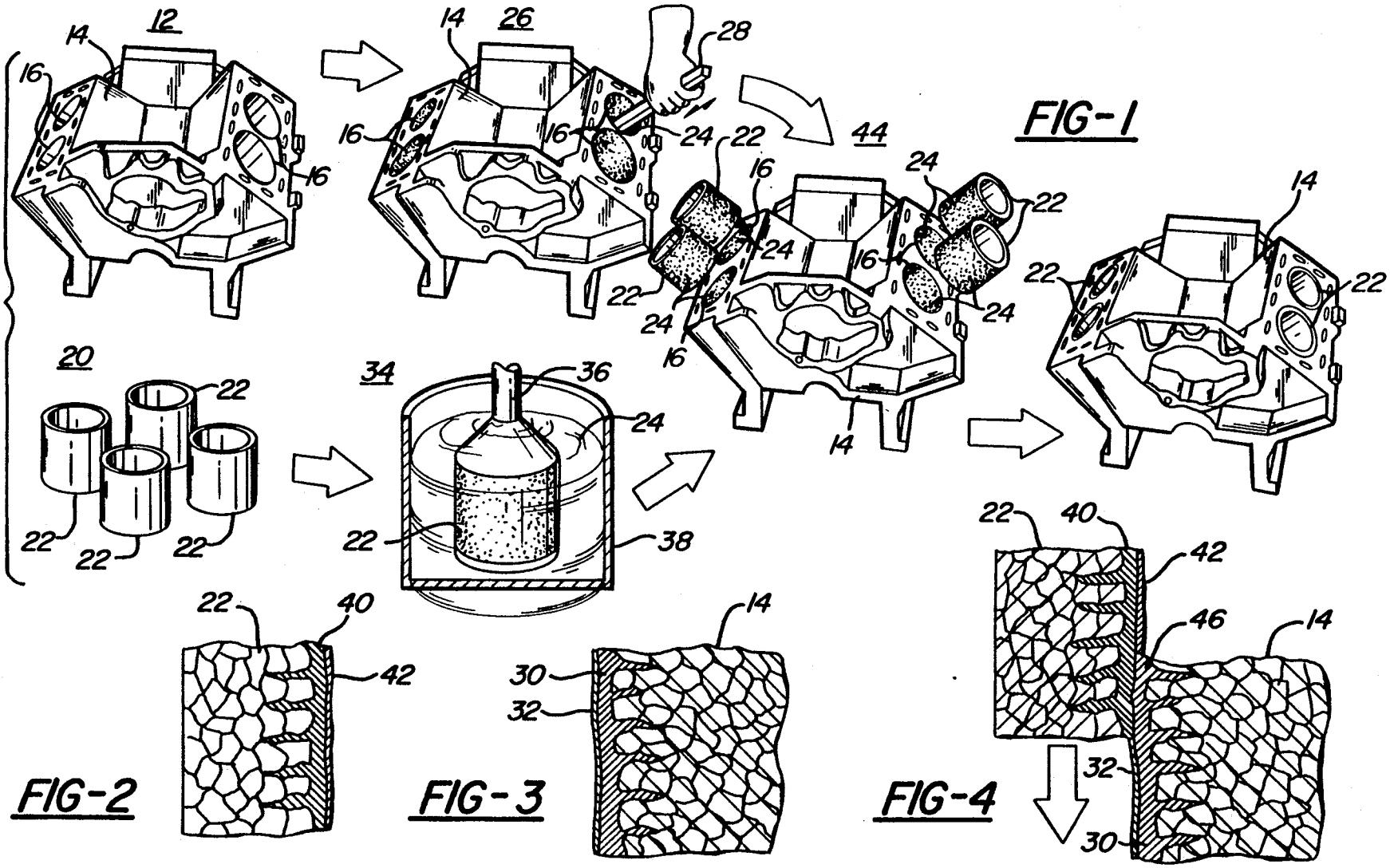
FIG. 1 is schematic flow diagram illustrating the method for metallurgically bonding the liners to the cylinder block.
FIG. 2 is a fragmentary cross-sectional view of the as-coated liner.
FIG. 3 is a cross-sectional view similar to FIG. 2 but of the as-coated walls of the piston cylinder.
FIG. 4 is a schematic fragmentary view showing the liner being press fitted into the piston cylinder causing the oxide layers to shear and the alloyed phases to combine to form a metallurgical bond between the liner and the cylinder wall.

Referring to FIG. 1, a schematic flow diagram of a preferred method of the subject invention is generally shown at 10.

As illustrated station 12 of FIG. 1, a cast aluminum cylinder block 14 is formed with one or more cylindrical walls 16 defining associated piston cylinders of the cylinder block 14. The cylinder block 14 is fabricated from any of a number of castable aluminum alloys which are well suited for cylinder blocks and may be formed by any of a number casting processes including sand mold casting, permanent casting, lost foam, etc., which are conventional to the block casting art.

The piston cylinders 16 extend into the cylinder block 14 and are formed with a predetermined fixed inner diameter $D_1$. Four such piston cylinders 16 are illustrated in FIG. 1 as forming part of a four cylinder V-type cylinder block 14.

As illustrated at station 20, one or more cylindrical-shaped tubular liners 22 are formed corresponding in number to the number piston cylinders 16 of the block 14. Thus, in the illustration of FIG. 1, four such liners 22 have been formed. The liners 22 are formed of high wear-resistant metal material, such as cast iron, steel or high silicon content aluminum alloys. The liners 22 are formed by either casting or extruding the chosen material into the cylindrical-tubular shape. The liners 22 have an outer surface diameter $D_2$ which is slightly larger than the inner diameter $D_1$ of the piston cylinders 18 for an interference fit therewith. It is preferred that the outer diameter $D_2$ of the liners 22 exceed the inner diameter $D_1$ of the piston cylinders 16 by about 5-10/10,000.

Once the cylinder block 14 and liners 22 have been formed, the next step is to apply a low melting molten coating material 24 to the outer surface of the liners 22 and to the walls 16 of the piston cylinders 16. This low-melting point coating material 24 is preferably zinc, but may be other low melting point metals, such as tin or cadmium. In any event, the selected coating material 24 should be compatible with the aluminum cylinder block material and with the chosen liner metal such that it readily alloys with these materials.

As illustrated at station 26, the walls 16 of the piston cylinders 16 are preferably coated by wire brushing the molten coating material 24 onto the walls of the cylinders 16. This can be accomplished by simply dipping a wire brush 28 into a bath (not shown) of the molten coating material 24 and then applying it to the preheated cylinder walls 16. The block 14 is preferably heated to about 840° F. prior to coating.

As shown in FIG. 3, the coating material 24 wets the surface of the cylinder walls 16 and penetrates the grain boundary structure of the cylinder block 14. Furthermore, as a molten coating material 24 wets the walls of the piston cylinders 16, it is caused to intermix or alloy with the aluminum cylinder block metal, forming an alloyed phase 30 on the walls of the piston cylinders 16. The alloyed phase 30 thus comprises the aluminum cylinder block material alloyed with the base coating material 24. In the case of a zinc coating material 24, the alloyed phase 30 comprises a zinc-aluminum alloy.

Thus, the coating material 24 does not just coat the walls of the piston cylinders 16, but rather alloys with the aluminum cylinder block material and develops the new alloyed phase 30 on the wall of the piston cylinders 16.

As the alloyed phase 30 cools from a molten state a solid state, a thin oxide layer 32 forms on the outer surface of the alloyed phase 30, caused by the alloyed 30 being exposed to the external oxidizing atmosphere during solidification. When zinc is used as a coating material 24, this oxide layer 32 comprises essentially zinc oxide.

As illustrated at station 34 of FIG. 1, the preferred method for coating the outer surface of the liners 22 is to secure the liners 22 in a suitable fixture 36, heat them to about 1200° F. and then immerse the liners 22 in a bath 38 of the molten coating material 24. As with the cylinder block 14, the molten coating material 24 wets the outer surface of the liner 22 and penetrates the grain boundary structure of the liner 22, as illustrated in FIG. 2. Furthermore, the coating material 24 alloys or combines with the liner material, thereby forming an alloyed phase 40 on the outer surface of the liners 22, in the identical manner as with the cylinder block 14. When cast iron is used as the liner material and zinc as a coating material 24, the alloyed phase 40 comprises iron liner material alloyed with the zinc coating material 24.

When a high wear resistant grade of aluminum is used as the liner materials, the coating process varies somewhat. In particular, it has has been found that applying ultrasonic waves to the bath of coating material (e.g., zinc) promotes better wetting of the outer surface of the liners 22 and results in a superior alloyed phase 40. With aluminum as the liner material and zinc as the coating material, the alloyed phase 40 comprises zinc alloyed with aluminum.

Like the alloyed phase 30 of the cylinder block 14, the alloyed phase 40 of the liners 22 develops an outer thin oxide layer 42 on the outer phase 40, as the alloyed phase 40 solidifies in the normal oxidizing atmosphere. With a zinc coating material, this oxide layer 42 comprises zinc oxide.

Once the walls of the piston cylinders and the outer surface the liners 22 have been coated, the liners 22 and cylinder block 14 are heated to an elevated temperature and then the liners 22 are pressed into the piston cylinders 16, as illustrated at station 44 of FIG. 1.

The alloyed phases 30, 40 have characteristic liquidus $L_1$, $L_2$ and solidus $S_1$, $S_2$ temperatures, above the liquidus temperatures $L_1$ $L_2$ which the alloyed phases 30, 40 are in a completely liquid or molten state and below the solidus temperatures $S_1$, $S_2$ which the alloyed phases 30, 40 are in a completely solid state. Between the liquidus $L_1$, $L_2$ and solidus $S_1$, $S_2$ temperatures, however, the alloyed phases 30, 40 are in so-called slushy state in which the liquid and solid states coexist, as is characteristic of all alloys heated to a temperature between their liquidus and solidus temperatures.

As was mentioned above, the cylinder block 14 and liners 22 ar heated before the liners 22 are pressed into the piston cylinders 16. More specifically, the cylinder block 14 is heated to a temperature between the liquidus $L_1$ and solidus $S_1$ temperatures of the alloyed phase 30 on the wall of the piston cylinders 16. Likewise, the liners 22 are heated to a temperature between the liquidus $L_2$ and solidus $S_2$ temperatures of the alloyed phase 40 on the outer surface of the liners 22. In this way, both alloyed phases 30, 40 are transformed from a solid state to a slushy state. In practice, this means heating the block 14 and liner 22 to about 820°-850° F.

As the liners 22 are pressed with an interference fit into the piston cylinders 16 of the cylinder block 14, the alloyed phases 30, 40 are caused to rub against one another during insertion, as illustrated schematically in FIG. 4. This rubbing or scuffing action disturbs the oxide layers 32, 42 present on the outer surface of the alloyed phases 30, 40 and allows the alloyed phases 30, 40 to further mix or alloy with one another as well as additional alloying with the cylinder block and liner metals. Thus, mechanically shearing the oxide layers 32, 42 during insertion of the liners 22 in combination with the slushy state of the underlying alloyed phases 30, 40 allows for intermixing or alloying of the alloyed phases 30, 40 and the formation a metallurgically bonded region 46 (FIG. 5) upon solidification. The metallurgically bonded region 46 thus comprises a mixture the coating material alloyed with both the cylinder block metal and the liner metal. For instance, when the liner is made of cast iron and the coating material 24 is zinc, the metallurgically bonded region 46 comprises the zinc coating material 24 alloyed with the iron liner and aluminum block metals.

The invention has been described in an illustrative manner, and it is to be understood that the terminology which has been used is intended to be in the nature of words of description rather than of limitation.

Obviously, many modifications and variations of the present invention are possible in light of the above teachings. It is therefore, to be understood that within the scope of the appended claims the invention may be practiced otherwise than as specifically described.

What is claimed is:

1. A method for metallurgically bonding a cylinder liner to a cylinder block of an internal combustion engine, said method comprising the steps of;

casting a metal cylinder block (14) having at least one cylindrical wall defining a piston cylinder (16) of fixed inner diameter $D_1$;

forming a cylindrical-shaped tubular liner 22 from high wear-resistant metal material having an outer surface diameter $D_2$ slightly larger than the inner diameter $D_1$ of the piston cylinder (16);

applying low melting point molten coating material (24) to one of the outer surface of the liner (22) and the cylinder wall (16);

heating the cylinder block (14) and the liner (22) to an elevated temperature;

and then forcing the liner (22) into the piston cylinder (16) with an interference fit causing the coating material (24) to alloy with the liner and cylinder block metals forming a metallurgically bonded region (46) between the liner (22) and cylinder wall (16), joining the same together.

2. A method as set forth in claim 1 further characterized by applying the coating material (24) to both the outer surface of the liner (22) and the walls of the piston cylinder (16).

3. A method as set forth in claim 2 further characterized by applying the coating material (24) in such a way that the coating material (24) penetrates the grain boundary structure of the outer surface of the liner (22) and the wall of the piston cylinder (16) and further alloys with the liner and cylinder block metals for forming alloyed phases (30, 40) on the liner (22) and cylinder wall (16).

4. A method as set forth in claim 3 further characterized by forming an outer oxide layer (32, 42) on the alloyed phases (30, 40) of the cylinder walls (16) and the liner (22).

5. A method as set forth in claim 4 further characterized by mechanically shearing the oxide layers (32, 42) as the liner (22) is forced into the piston cylinder (16) with an interference fit for exposing and marriaging unoxidized alloyed phase material (40) of the liner (22) with the unoxidized alloyed phase material (30) of the cylinder walls (16), whereby the two alloyed phases (30, 40) inner mix with one another and further with the liner and cylinder block metal for forming a metallurgically bonded region (46) between the liner (22) and the cylinder block (14).

6. A method as set forth in claim 5 wherein the alloyed phases (30, 40) of the cylinder wall (16) and liner (22) have characteristic liquidus $L_1$, $L_2$ and solidus $S_1$, $S_2$ temperatures, further characterized by heating the cylinder block (14) and liner (22) to a temperature above the solidus temperatures $S_1$, $S_2$ of the alloyed phases (30, 40) but below their liquidus temperatures $L_1$, $L_2$ for transforming the alloyed phases (30, 40) into a slushy state before forcing the liner (22) into the piston cylinder (16).

7. A method as set forth in claim 1 further characterized by applying zinc as the coating material (24).

8. A method as set forth in claim 1 further characterized by applying tin as the coating material (24).

9. A method as set forth in claim 1 further characterized by forming the liner (22) from cast iron.

10. A method as set forth in claim 1 further characterized by forming the liner (22) from steel.

11. A method as set forth in claim 1 further characterized by forming the liner (22) from high silicon content aluminum.

12. A method as set forth in claim 1 further characterized by casting the cylinder block (14) from aluminum.

13. A method as set forth in claim 1 further characterized by forming the liner (22) and piston cylinder (16) with a 5-10/10,000 interference fit.

* * * * *